US011260550B2

(12) United States Patent
Neyer et al.

(10) Patent No.: US 11,260,550 B2
(45) Date of Patent: Mar. 1, 2022

(54) PERSONAL CARE DEVICE

(71) Applicant: Braun GmbH, Kronberg (DE)

(72) Inventors: Christian Neyer, Eschborn (DE); Martin Fuellgrabe, Bad Camberg (DE); Stefan Fuerst, Kronberg (DE); Evelyn Marion Zechel, Hattersheim (DE)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 17/075,934

(22) Filed: Oct. 21, 2020

(65) Prior Publication Data

US 2021/0031386 A1 Feb. 4, 2021

Related U.S. Application Data

(63) Continuation of application No. 16/107,604, filed on Aug. 21, 2018, now abandoned.

(30) Foreign Application Priority Data

Aug. 30, 2017 (EP) ..... 17188555

(51) Int. Cl.
*B26B 19/38* (2006.01)
*B26B 19/46* (2006.01)

(52) U.S. Cl.
CPC ..... *B26B 19/388* (2013.01); *B26B 19/38* (2013.01); *B26B 19/382* (2013.01); *B26B 19/46* (2013.01); *B26B 19/3853* (2013.01)

(58) Field of Classification Search
CPC ..... B26B 19/388; B26B 19/38; B26B 19/46; B26B 19/3853; B26B 19/382;
(Continued)

(56) References Cited

U.S. PATENT DOCUMENTS 5,111,580 A 5/1992 Bosscha et al.
6,460,251 B1 * 10/2002 Orloff ..... B26B 21/4056 30/34.05
(Continued)

FOREIGN PATENT DOCUMENTS

CN 104723368 6/2015
CN 111032295 A 4/2020
(Continued)

OTHER PUBLICATIONS

European Search Report dated Mar. 8, 2018.
(Continued)

*Primary Examiner* — Ghassem Alie
(74) *Attorney, Agent, or Firm* — Gerd Zetter; Kevin C. Johnson

(57) ABSTRACT

A skin treatment device such as an electric shaver, having a housing forming an elongated handle for manually moving the device along a body surface, a working head attached to the handle for effecting a treatment to the body surface, at least one detector for detecting at least one treatment parameter of the device, and a feedback indicator for indicating feedback information based on the detected treatment parameter to a user during the personal care treatment. More particularly, such feedback indicator includes a light emitter configured to emit light signals onto a mirror in front of a user.

8 Claims, 5 Drawing Sheets

(58) Field of Classification Search
CPC ..... B26B 21/46; B26B 19/00; B26B 19/28; B26B 21/40; H05B 37/0218; F21L 4/00; F21V 21/26; F21V 21/00; F21V 21/32; A45D 2026/008
USPC ..... 30/45, 34.05, 537; 362/183, 115; 348/376, 308, 311, 222.1, 333.01
See application file for complete search history.

(56) References Cited

U.S. PATENT DOCUMENTS

| | | | | |
|---|---|---|---|---|
| 6,836,966 | B2 | 1/2005 | Patrick | |
| 6,871,402 | B2 * | 3/2005 | Bader | B26B 19/46 30/43.92 |
| 7,100,283 | B1 | 9/2006 | Grdodian | |
| 8,230,600 | B2 | 7/2012 | Hart | |
| 8,449,134 | B2 | 5/2013 | Lin | |
| 2002/0088121 | A1 | 7/2002 | Jacobsen | |
| 2008/0250645 | A1 | 10/2008 | Tringali | |
| 2010/0186234 | A1 | 7/2010 | Binder | |
| 2012/0227554 | A1 | 9/2012 | Beech | |
| 2012/0268923 | A1 | 10/2012 | Lin | |
| 2014/0102271 | A1 | 4/2014 | Krenik | |
| 2015/0298327 | A1 | 10/2015 | Tomassetti | |
| 2016/0143410 | A1 | 5/2016 | Stampe et al. | |
| 2017/0113360 | A1 | 4/2017 | Godlieb | |
| 2017/0291319 | A1 | 10/2017 | Hendriks et al. | |
| 2017/0305020 | A1 | 10/2017 | Darwinkel et al. | |
| 2019/0061183 | A1 | 2/2019 | Neyer et al. | |
| 2019/0275687 | A1 | 9/2019 | Nijdam | |
| 2019/0358835 | A1 | 11/2019 | Rao Ganesh | |
| 2020/0033448 | A1 | 1/2020 | Bourquin | |
| 2020/0316799 | A1 * | 10/2020 | Tsegenidis | B26B 21/4056 |

FOREIGN PATENT DOCUMENTS

| | | | |
|---|---|---|---|
| DE | 19601780 | C1 | 6/1997 |
| DE | 102010023681 | A1 | 12/2011 |
| DE | 202012004070 | U1 | 6/2012 |
| EP | 1165294 | A1 | 1/2002 |
| EP | 1549468 | A1 | 7/2005 |
| EP | 2888086 | B1 | 3/2016 |
| EP | 3082020 | A1 | 10/2016 |
| EP | 3183992 | A1 | 6/2017 |
| EP | 3450120 | A1 | 3/2019 |
| JP | H01127981 | | 5/1989 |
| JP | 2002239270 | A | 8/2002 |
| WO | 03015999 | A2 | 2/2003 |
| WO | 2015165935 | A1 | 11/2015 |
| WO | 2016041929 | A1 | 3/2016 |
| WO | 2017032547 | A1 | 3/2017 |
| WO | 2019043503 | A1 | 3/2019 |

OTHER PUBLICATIONS

Communication Pursuant to Article 94(3) dated Dec. 16, 2019; European Patent Office, Munich, Germany.
International Search Report and Written Opinion dated Dec. 5, 2018; Application No. PCT/IB2018/056314; International Bureau of WIPO.
International Preliminary Report on Patentability dated Mar. 12, 2020; Application No. PCT/IB2018/056314; International Bureau of WIPO.
All Office Actions; U.S. Appl. No. 16/107,604.

* cited by examiner

PERSONAL CARE DEVICE

RELATED APPLICATION

This application is a continuation of application U.S. Ser. No. 16/107,604, filed Aug. 21, 2018, and entitled "PERSONAL CARE DEVICE," the disclosure of which is incorporated herein by reference.

FIELD OF THE INVENTION

The present invention relates to a personal care device, in particular skin treatment device such as electric shaver, comprising a housing forming an elongated handle for manually moving the personal care device along a body surface, a working head attached to said handle for effecting a personal care treatment to said body surface, at least one detector for detecting at least one treatment parameter of said personal care device, and a feedback indicator for indicating feedback information based on the detected treatment parameter to a user during the personal care treatment. More particularly, such personal care device may be a hair removing device such as an epilator or a shaver, wherein such shaver may be an electric shaver comprising at least one cutter unit, a drive unit for driving said at least one cutter unit and a display device for displaying information.

BACKGROUND OF THE INVENTION

Electric shavers usually have one or more cutter elements driven by an electric drive unit in an oscillating manner where the cutter elements reciprocate under a shearfoil, wherein such cutter elements or undercutters may have an elongated shape and may reciprocate along their longitudinal axis. Other types of electric shavers use rotatory cutter elements which may be driven in an oscillating or a continuous manner. Said electric drive unit may include an electric motor or an electric-type linear motor, wherein the drive unit may include a drive train having elements such as an elongated drive transmitter for transmitting the driving motion of the motor to the cutter element, wherein the motor may be received within the handle portion of the shaver or in the alternative, in the shaver head thereof.

Although such shavers are used on a daily basis by most users, it is sometimes difficult to operate and handle the shaver indeed perfectly. For example, the working head with the cutter elements may be pressed against the skin too strongly, or the shaver may be held at an orientation preventing the working head's shear foils from full contact with the skin, even if the working head is pivotably supported to compensate for some angular displacement. Sometimes it is also difficult to move the shaver along the skin at the right velocity in the right direction to the relevant skin portions. Appropriate use of the shaver becomes even more difficult when the shaver provides for various different operating modes and complex functions.

For example, a shaver's drive units are sometimes operable in different operation modes, wherein for example the cutter speed or oscillation frequency may be varied to increase shaving efficiency in a fast mode or highspeed mode, whereas power consumption may be reduced in a slow mode or low speed mode. Depending on the fittings of the shaver, other operation modes may be offered and may include a long-hair cutting mode or a fluid application mode in which a lubricating applicator such as a spray nozzle is activated.

In order to give the user feedback which operation mode has been selected, such shavers may have a display device for displaying information about such operation mode. For example, the selected cutter speed may be indicated, or the activation of functional accessories such as the aforementioned fluid applicator or an airflow generator may be displayed.

In addition or in the alternative to displaying such information on the operation mode, other information may be displayed by such display devices. For example, the charging status of a battery or accumulator of the shaver may be indicated, or the shaving time may be displayed, wherein such additional information also may be displayed when the shaver or the drive unit thereof is inactive. For example, it has been suggested to extend the activity of the display to a period of some seconds after switching off the shaver so that, for example, the battery charge level is indicated for some seconds after switching off the shaver and thereafter, fading out to the idle mode in which no information is displayed.

Although such display devices may give some feedback information to a user, appropriate use is still difficult, as such displays usually just inform about chosen operating options before or after the shaving process, whereas no feedback information is provided during shaving that could tell the user to modify shaving behavior.

So as to cope with such problem, it has been suggested in the prior art to use acoustic and/or visual and/or haptic feedback information to a user to give the user guidance for appropriately using the device.

For example, document WO 2017/032547 A1 discloses a shaving device giving a user shaving instructions acoustically and/or visually, wherein such shaving instructions such as "user gentle pressure only" or "use sensitive speed setting" are given based on usage data such as pressure data and/or motion data measured by the shaving device. It is also suggested to take into account usage data history to select the appropriate instruction from a stored list of instructions.

Document DE 196 01 780 C1 suggests to determine the pivoting angle of the shaver head relative to the shaver handle and to give an LED signal when the shaver head reaches its maximum pivoting position to warn the user that further angular displacement of the handle may not be compensated. In addition to such LED signal, it is mentioned that an acoustic or haptic warning signal may be given, for example in terms of a change in rotatory speed of the motor that can be felt by a user.

WO 2015/165935 discloses a shaver with a feedback module to provide visual, audible and/or tactile feedback to a user in response to the angular orientation of the shaver that is detected by an angular orientation sensor. The visual feedback may include a laser beam signal displaying a visible line on the part of the body to be treated.

EP 2888086 B1 shows a shaver producing an optical or acoustic warning signal when the user presses the hair cutting member against the skin with excessive force. Such excessive force is determined by measuring axial displacement of the hair cutting module relative to the handle supporting the hair cutting module via a spring device.

EP 1549468 B1 describes a shaver which detects proper contact of the shear foils with the skin to be shaved, wherein it is mentioned that such contact may be detected by means of an inductive sensor, a capacitance sensor or an optical sensor which may include a light barrier immediately above the shear foil. It is suggested to automatically vary the position of the shaver head relative to the handle by means of an actuator for pivoting or tilting the shaver head, when there is improper contact to the skin.

EP 3183992 A1 also suggests to detect proper skin contact of a shaver, wherein such contact is detected by a mechanical detector having a spring-biased tracer pin, and in addition by means of measuring the torque required for driving the cutter.

EP 3082020 A1 shows a shaver having different operation modes, wherein the chosen operation mode is indicated on a display unit showing a respective symbol.

DE 10 2010 023 681 B4 discloses a shaver having an acceleration sensor for measuring accelerations of the shaver due to manual handling thereof and determining a three-dimensional movement pattern in response to which a cutter is switched on and off and a long hair trimmer is activated or deactivated.

EP 1165294 B1 discloses a shaver measuring the gripping force applied to the housing by a user's hand, wherein LEDs emit green, yellow and red light to indicate the actual gripping force is too low, average or too high. The gripping force applied to the handle is assumed to be indicative of the force with which the shaving head is applied to the skin so gripping the handle with excessive force indicates excessive pressure of the shaver's head.

US 2002/0088121 A1 suggests a shaver having an LED display to indicate whether the user should be shaving faster or slower or should use more shaving cream, wherein proper shaving speed is detected by means of an accelerometer and use of shaving cream is detected by a microphone detecting shaving noise.

SUMMARY OF THE INVENTION

It is an objective underlying the present invention to provide for an improved personal care device avoiding at least one of the disadvantages of the prior art and/or further developing the existing solutions. A more particular objective underlying the invention is to provide for an improved displaying of feedback information to the user.

A further objective underlying the invention is to provide for an improved perception of information to be displayed to the user during shaving without sacrificing easy handling of the shaver. More particularly, a self-explaining, intuitive handling and use of the information function of the shaver should be achieved.

A still further objective underlying the invention is to provide for an improved multipurpose personal care appliance offering appropriate operating guidance during use to users with different operating habits.

To achieve at least one of the aforementioned objectives, it is suggested to send a light signal from the personal care device to a mirror in which a user is usually watching the body surface currently treated to monitor the treatment process, so the user may perceive the light signal in the mirror reflecting the light signal. So as to reach a mirror positioned in front of a user, said light signal is emitted from the personal care device in a direction going from the personal care device substantially perpendicular to a mirror in front of a user using such personal care device in a typical orientation. Due to the elongated shape of the handle of the personal care device, there is an intuitive gripping sometimes referred to as "piper's grip", wherein the thumb grips a front side of the handle and the other four fingers grip a rear side of the handle with the longitudinal axis of the handle extending transverse to the fingers and/or substantially parallel to the first row of finger joints on the palm of the hand. The working head and the bottom end of the handle project from opposite sides of the gripping hand, wherein the middle portion of the handle is extending on the palm side of the hand surrounding said middle portion. The light emitter for emitting said light signal is configured to emit the light signal onto said mirror in front of a user, so that a user can see the light signal in the mirror, when the personal care device is held in such typical piper's grip onto the body surface to be treated.

More particularly, the feedback indicator includes a light emitter configured to emit light from an end portion of said elongated handle and/or from said working head with a main emission direction oriented towards a bottom side of the personal care device opposite to the working head and thus, downwardly when considering the personal care device in an upright position with the working head on top of it. In other words, the main emission direction of the light is going rearwardly away from a contact surface of the working head and thus, substantially perpendicular away from a body surface portion to be treated, as a user usually holds the body surface portion to be treated substantially parallel to and/or in front of the mirror to be able to see such body surface portion in the mirror.

According to a further aspect, the feedback information is adapted to the level of the detected treatment parameter so as to provide for substantially the full range of feedback information to users having different operating habits. More particularly, the personal care device includes a calibration device for calibrating the relation between the feedback information signal and the detected treatment parameter in response to user history of the detected treatment parameter. When detection of treatment parameters includes detection of a force with which the working head is pressed against the body surface to be treated and the feedback information includes different pieces of information indicative of low, average and high forces, the controller for controlling the feedback information may be calibrated to issue the information indicative of average force when the detected force corresponds to an average value of the detected forces of the user history.

These and other advantages become more apparent from the following description giving reference to the drawings and possible examples.

DETAILED DESCRIPTION OF THE INVENTION

Figure 1:
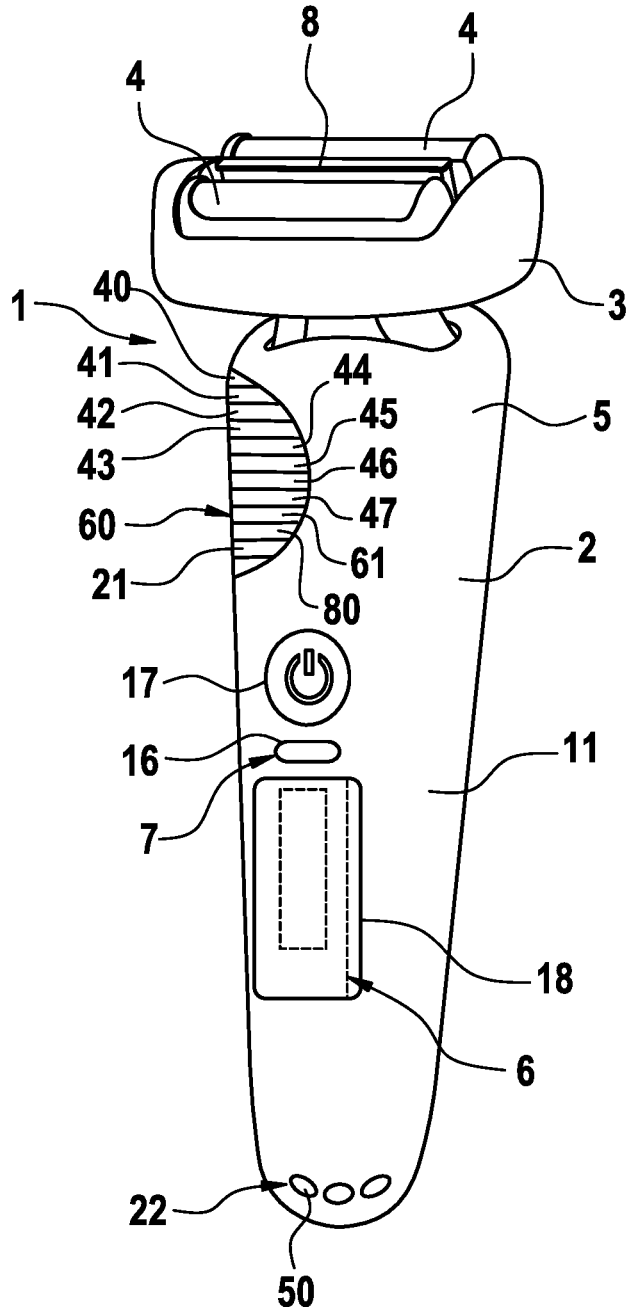
FIG. 1: a perspective view of an electric shaver comprising a handle and a shaver head connected thereto, wherein a display device of the shaver includes a display on the handle and a light emitter at a bottom portion thereof.

The personal care device offers comfortable ways of communicating relevant information to the user, wherein according to one aspect the user may easily perceive such information during use of the personal care device. In contrast to usual displays on a housing, the users do not need to see and watch the device's housing or any other element of the device, but gets the information presented on a mirror in front of a user.

More particularly, according to a first aspect, the handheld personal care device is adapted to send light signals to a mirror in which a user is usually watching the body surface currently treated to monitor the treatment process, so the user may perceive the light signal in the mirror reflecting the light signal. So as to reach a mirror positioned in front of a user, said light signal is emitted from the personal care device in a direction going from the personal care device rearwardly and/or to a bottom side thereof and thus away from the working head and away from the body portion onto which the working head is to be positioned for treatment. More particularly, the emission direction is away from the personal care device substantially perpendicular to a mirror in front of a user when such personal care device is held in a typical orientation for treating the user's body surface.

Due to the elongated shape of the handle of the personal care device, there is an intuitive gripping sometimes referred to as "piper's grip", wherein the thumb grips a front side of the handle and the other four fingers grip a rear side of the handle with the longitudinal axis of the handle extending transverse to the fingers and/or substantially parallel to the first row of finger joints on the palm of the hand. The working head and the bottom end of the handle project from opposite sides of the gripping hand, wherein the middle portion of the handle is extending on the palm side of the hand surrounding said middle portion. More particularly, a shaver's or epilator's handle is usually gripped with the thumb positioned onto the front side where an ON-OFF switch is positioned so the thumb may operate said ON-OFF switch, wherein often such ON-OFF switch is positioned on one of the two larger surfaces of a substantially cuboid handle. When the device is provided with a long hair trimmer on one side, said ON-OFF switch is often positioned on the opposite side of the handle. Such side having the ON-OFF switch may be considered as the front side of the handle.

The light emitter for emitting said light signal is configured to emit the light signal onto said mirror in front of a user, so that a user can see the light signal in the mirror, when the personal care device is held in such typical piper's grip onto the body surface to be treated.

More particularly, the feedback indicator includes a light emitter configured to emit light from an end portion of said elongated handle and/or from said working head with a main emission direction oriented towards a bottom side of the personal care device opposite to the working head and thus, downwardly when considering the personal care device in an upright position with the working head on top of it. In other words, the main emission direction of the light is going rearwardly away from a contact surface of the working head and thus, substantially perpendicular away from a body surface portion to be treated, as a user usually holds the body surface portion to be treated substantially parallel to and/or in front of the mirror to be able to see such body surface portion in the mirror.

The bottom portion of the handle may include electrical connectors for connecting the handheld device to a charging station and/or to an electric line for charging the batteries inside the handle. In any case, the bottom portion of the handle is the handle's portion furthest away from the working head. The aforementioned bottom side towards which the light is emitted, means the space neighboring said bottom end portion of the handle. When the personal care device is in an upright position with the working head on top of it, the bottom side is below the handle.

Advantageously, said light emitter may be configured to emit said light towards said bottom side as well as towards a rear side of the personal care device opposite to a front side where the handle has an On/Off switch, wherein said main emission direction is inclined at an acute angle to a longitudinal axis of the elongated handle.

More particularly, said light emitter can be configured to have a main emission direction at an angle from 80° to 10° or 60° to 20° to said longitudinal axis of the handle.

Furthermore, said light emitter may be configured to emit said light in terms of an illuminating pencil of more than 2×30° or 2×60° with a substantial uniform light intensity over the cross-section of said illuminating pencil.

More particularly, the light emitter may be configured to emit a substantially uniform bright light cone or light pyramid (when the cross-section is not circular) with a sufficiently large angle or divergence so that the light can be perceived well in the mirror, even when the angular position of the handle is varied during treatment. Advantageously, the emitted light may have any intensity that does not fall by more than a factor 100 within an angle of divergence between $\pi$ and $3\pi$, i.e. a range between a quarter and three quarters of the full solid angle or full spherical ($4\pi$).

Moreover, said light emitter may include a plurality of light sources of different light colors and/or at least one light source of variable light color, wherein a controller is provided for controlling said light emitter to vary the color of the emitted light in response to the at least one detected treatment parameter.

To avoid shading of the light emitter by the hand gripping the handle, said light emitter may be positioned at an end portion of said handle outside a middle portion of said handle forming a gripping portion. In this regard, one should note that the handle has two end portions uncovered by a hand gripping the handle in the middle portion thereof. One end portion is the aforementioned bottom portion furthest away from the working head, whereas another end portion of the handle is next to the working head. Providing a light emitter at said bottom portion avoids any shading by a gripping hand. When positioning a light emitter at the end portion next to the working head, it may be provided at an elevated position to be able to emit light over/beyond the fingers gripping the handle's middle portion towards the bottom side.

In the alternative or in addition, said or another light emitter may be positioned at the working head. In addition to the aforementioned optical feedback, the feedback indicator also might provide for acoustical information. Such acoustical feedback information might be given via a loudspeaker. However, according to a further aspect, the sound representing feedback information may be generated by means of varying the operation of the motor for driving the working head's working tools.

For modifying the motor sound, there are various options. More particularly, key motor output parameters such as amplitude and/or frequency and/or rotatory speed may be modulated. In addition or in the alternative, additional sound may be created by the motor by means of mixing a new signal into the driving signals of the motor.

The feedback information may take into account various treatment parameters. Depending on the type of treatment, the personal care device may include various detectors for detection of such parameters.

More particularly, the device may include at least one of the following detectors: a force detector for detecting the force pressing the working head onto the body surface, a touch detector for detecting contact of the working head with the body surface, a velocity and/or acceleration detector for detecting velocity and/or acceleration of the personal care device, a rotation detector for detecting rotation and/or orientation of the personal care device in three dimensions, a displacement detector for detecting linear and/or rotatory displacement of the working head relative to the handle, a cutting activity detector for detecting cutting activity of the personal care device, and/or a trimmer position detector for detecting a position of a long hair trimmer.

The said feedback indicator may be configured to indicate feedback information in response to various treatment parameters detected during use of the personal care device. More particularly, feedback information may be provided on the basis of at least one of the following detected treatment parameters: the force pressing the working head onto the body surface, contact of the working head with the body surface, velocity and/or acceleration of the personal care device, rotation and/or orientation of the personal care device in three dimensions, linear and/or rotatory displacement of the working head relative to the handle, cutting activity of the personal care device, and the position of a long hair trimmer.

The feedback indicator may indicate feedback information based on a current value of the at least one detected treatment parameter and/or on the basis of a history of values of said at least one detected treatment parameter.

According to a further aspect, so as to allow for rendering substantially the full range of feedback information to users having different operating habits, the personal care device is provided with a calibration device. More particularly, the personal care device includes a calibration device for calibrating the relation between the feedback information signal and the detected treatment parameter in response to user history of the detected treatment parameter. When detection of treatment parameters includes detection of a force with which the working head is pressed against the body surface to be treated and the feedback information includes different pieces of information indicative of low, average and high forces, the controller for controlling the feedback information may be calibrated to issue the information indicative of average force when the detected force corresponds to an average value of the detected forces of the user history.

Such calibration device may calibrate the feedback indicator on the basis of user history of the values of the detected treatment parameters mentioned above.

The calibration device may include an adaptive controller for adaptively controlling the feedback indicator in response to the at least one detected treatment parameter to provide for different feedback information for different treatment parameters within the range of the values of the detected feedback parameter of the user history thereof.

When the feedback indicator includes the aforementioned light emitter emitting light of different colors to give light-color based feedback information to the user, said adaptive controller may vary the functional relation of the color of light emitted by the light emitter to a detected force of the working head onto the body surface and/or to another treatment parameter detected.

The personal care device may include a display on the shaver handle, wherein such display may include, for example, an LED display device or other suitable display types.

In order to achieve a space-saving display arrangement, the display device may include at least one display field which is used for displaying information relative to the operation modes as well as information relative to other aspects of the shaver such as the aforementioned charging level, shaving time, cleaning status or wear and tear status. For example, such display field may be configured to display pictograms such as a cascade or row of display points or LEDs.

In addition or in the alternative to a display provided on the electric shaver itself, a display may be provided on a cleaning and/or loading station configured to receive and/or be connected to the electric shaver so as to charge the shaver's battery and/or clean the shaver, wherein a fluid may be applied to the shaver head to clean the shaver. Such cleaning and/or charging station may include a display device configured to communicate with the electric shaver at least when the shaver is docked into the station so as to display the aforementioned information. If in addition the shaver is provided with said display/LED it is advantageous to better recognize the signal provided by said display/LED. This is realized by a basically upside down (so opposite to the shavers upright position) storage and holding of the shaver within a cleaning tub of a cleaning/loading station so that a display at the back sides of the head or the handle can be well seen.

These and other features become more apparent from the example showing in the drawings. As can be seen from FIG. 1, the shaver 1 may have a shaver housing forming a handle 2 for holding the shaver, which handle may have different shapes such as—roughly speaking—a substantially cylindrical shape or box shape or bone shape allowing for economically grabbing the shaver.

On one end of the shaver 1, a shaver head 3 is attached to the handle, wherein the shaver head 3 may be slewably supported about one or more slewing axes.

The shaver head 3 includes at least one cutter unit 4 which may include a cutter element or undercutter reciprocating under a shearfoil. The shaver head 3 may also include a long hair cutter 8 as it is shown by FIG. 1.

So as to drive such cutter unit 4 and the long hair cutter 8, a drive unit 5 may include a motor that can be received within the handle 2 and can be connected to the cutter unit 4 and the long hair cutter 8 by means of a transmitter or drive train extending from the motor to the cutter unit.

As can be seen from FIG. 1, an ON-OFF switch or power switch 17 may be arranged at the handle 2, for example on a front side FS of said handle 2. By means of such power switch 17, the drive unit 5 may be started and switched off again.

As can be seen from FIG. 1, the shaver 1 further includes a display 18 which may be provided on the handle 2, for example on a front side FS thereof. Such display 18 may be part of a display device 6 further including additional electronic components or other elements such as a display controller 11, a memory, power supply components etcetera.

The display 18 may show various shaver parameters as e.g. on/off status or battery loading status and others.

After an initialization procedure or in the alternative thereto, the display 18 may display the battery level, wherein the number of the cascade bars lightening may correspond to the battery level.

As can be seen from FIG. 1, the shaver 1 may further include an input element 7 in terms of, for example, a touchbutton 16 which may be positioned in the neighborhood of the power switch 17.

The aforementioned display 18 is helpful in presenting information to a user before or after shaving, whereas during shaving it is rather difficult to read information on such display. In order to give a user guidance during shaving, the shaver 1 comprises a feedback indicator 22 presenting feedback information on a mirror 70 in front of a user. As it is well-known, a mirror 70 is used when shaving the user's skin, cf. FIG. 2.

Figure 2:
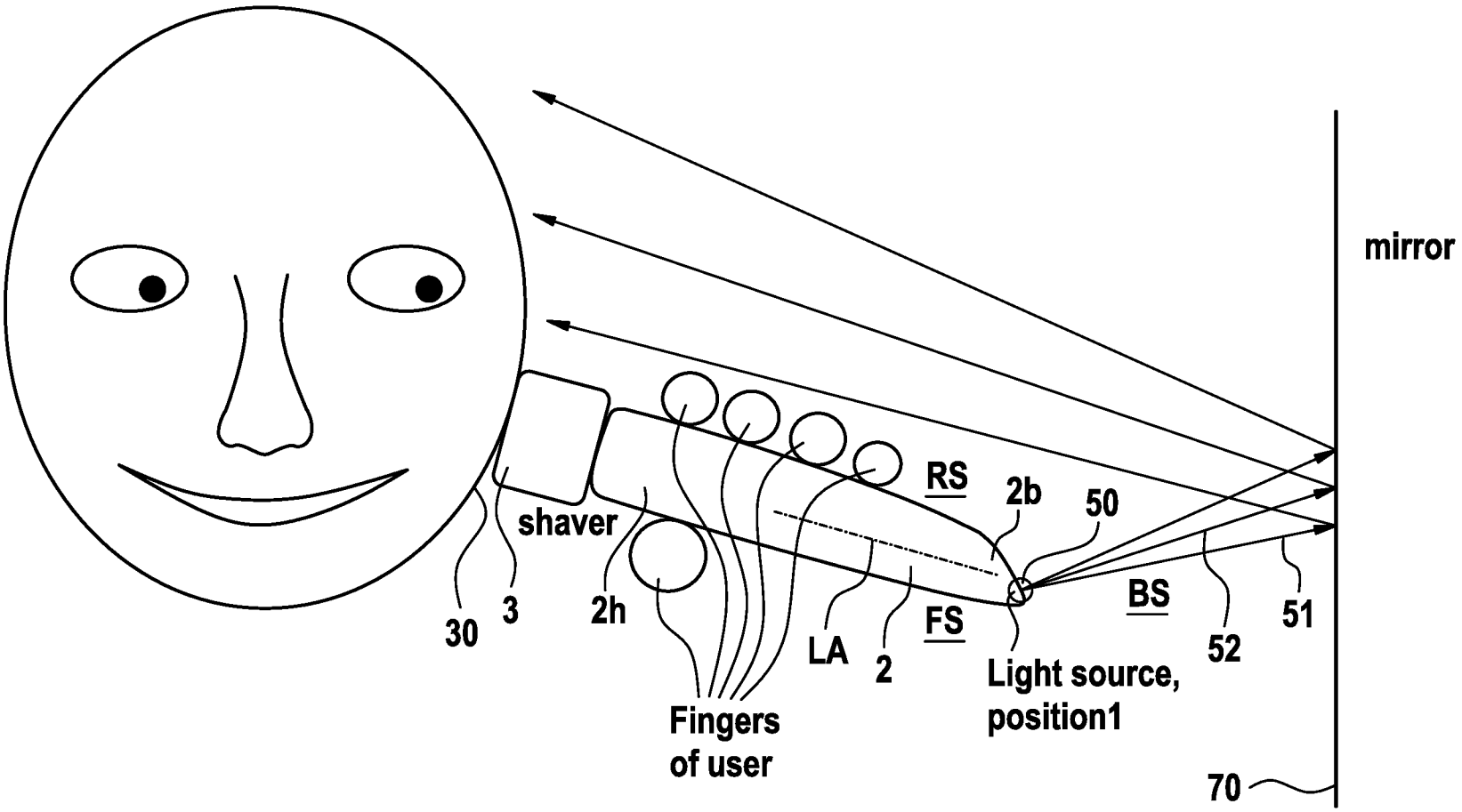
FIG. 2: a schematic view of the shaver's light emitter at the bottom portion of the handle sending light signals towards the mirror during use of the shaver.

So as to present the feedback information onto said mirror 70, the feedback indicator 22 may include a light emitter 50 which may be positioned at a bottom portion 2*b* of the handle 2. As shown by FIG. 2, such bottom portion 2*b* usually projects from a hand gripping the handle 2 so there is no shading by the hand. When the handle 2 is held in a "piper's grip" as it is shown in FIG. 2, the bottom portion 2*b* of the handle 2 is extending towards said mirror 70 and thus, the light emitter 50 may directly emit light 51 directly onto the mirror 70, wherein such light 51 may form a luminous pencil such as a light cone with a diverging angle of at least 2×30° or 2×45° or 2×60° or even 2×80° or more. The distribution of the emitted light 51 may be controlled by means of some optics or optical elements such as a lens and/or a reflector associated with a light source. Advantageously, the light emitter 50 is configured to provide for a substantially uniform light intensity and/or brightness over at least a significant portion of the luminous pencil. For example, in a cross-sectional area with the lowest intensity, such intensity may be at least 25% or 30% or 45% or 50% or 60% or more of the maximum intensity which may be given in a central section of the luminous pencil, for example.

As can be seen from FIG. 2, the emitted light 51 is reflected by mirror 70 back to the user's eyes so the user easily may perceive the light signal.

As can be seen from FIG. 2, the light emitter 50 may be configured to emit light 51 with a main emission direction 52 going away from the working head 3 and thus, away from the user's skin. More particularly, said main emission direction 52 may be inclined to the longitudinal axis LA of the handle 2 at an acute angle towards a bottom side BS of the handle and slightly to the rear side RS which is the handle's side opposite to its front side FS where a thumb grips the handle 2 and/or an ON-OFF switch may be provided.

The main emission direction 52 may be inclined to the handle's longitudinal axis LA at an angle of, e.g., 10° to 40° or 25° to 35° or about 30°. Such orientation of the main emission direction 52 may compensate for the usual inclination of the handle 2 to a horizontal line during normal operation, i.e. normal shaving.

Figure 3:
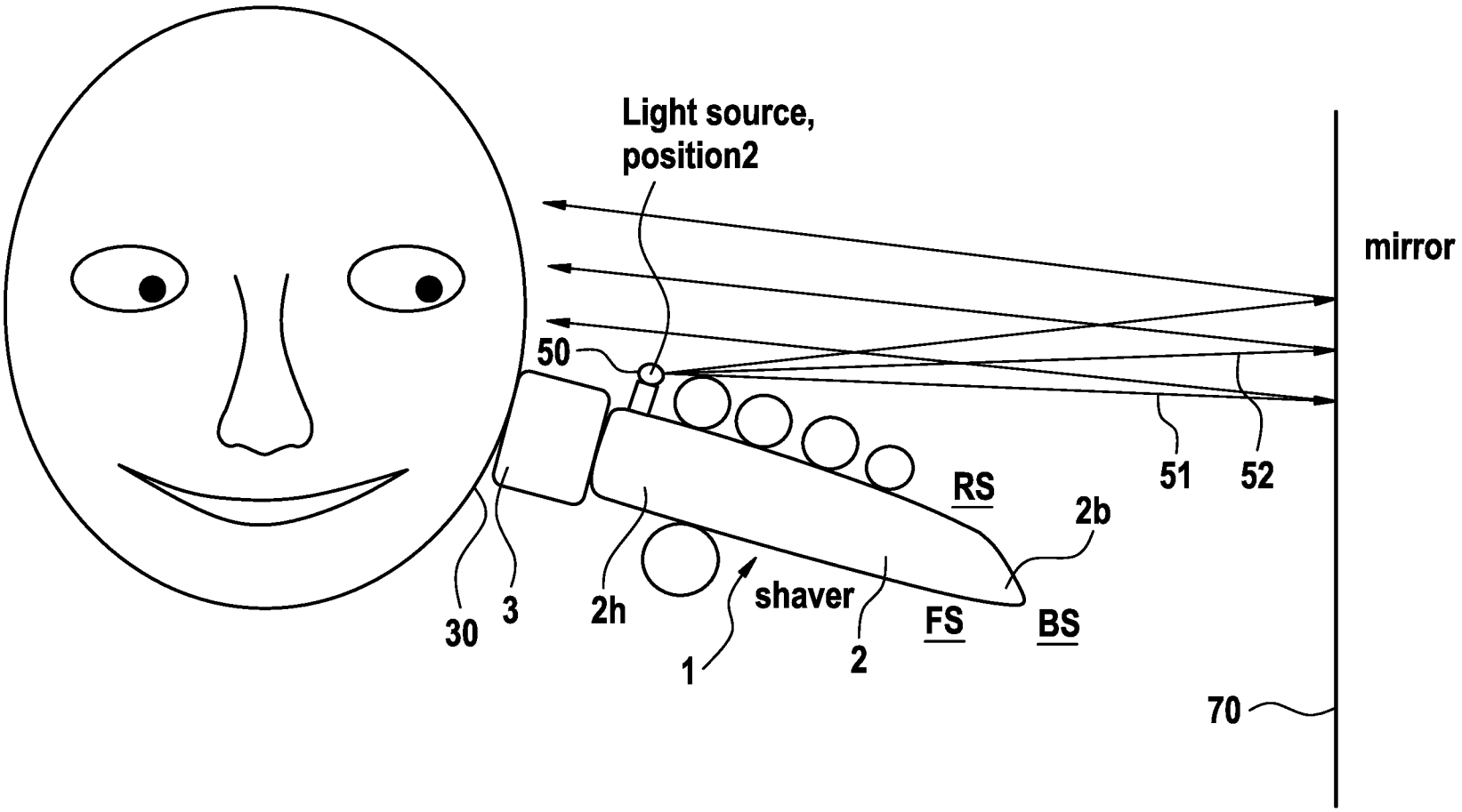
FIG. 3: a schematic view of a shaver similar to FIG. 2 according to a further embodiment, wherein the shaver's light emitter is positioned at a top portion of the handle adjacent to the shaver head, wherein said light emitter—similarly to FIG. 1—sends light signals to a mirror used during shaving.

As can be seen from FIG. 3, the light emitter 50 also may be positioned at a top end portion 2*h* adjacent to the working head 3, wherein the light emitter 50 may be positioned at an elevated portion of the handle to be able to emit light 51 over the fingers of a gripping hand and to avoid shading by the fingers when emitting light 51 backwardly towards the bottom side BS. Nevertheless, the main emission direction 52 and the light distribution over a luminous pencil may be as described before.

Figure 4:
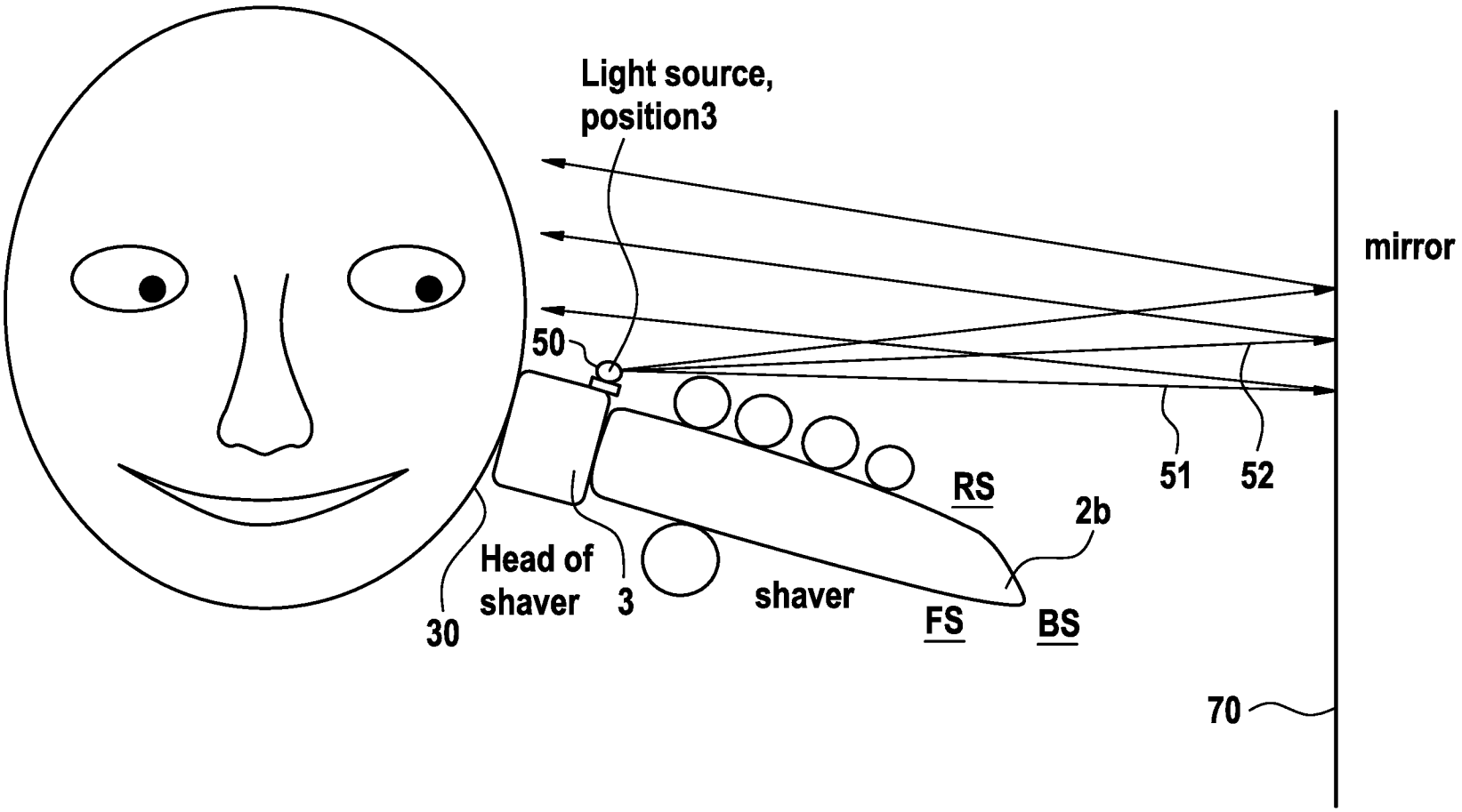
FIG. 4: a schematic view of a shaver similar to FIG. 2 according to a further embodiment, wherein the shaver's light emitter is positioned at the shaver head, wherein said light emitter—similarly to FIG. 1—sends light signals to a mirror used during shaving.

As can be seen from FIG. 4, the light emitter 50 also may be positioned at the working head 3, wherein also in this embodiment the main emission direction 52 and the light distribution over a light cone or luminous pencil may be as described before.

The light emitter 50 may be configured to emit light 51 of different colors, wherein advantageously the light color may be adjusted stepwise or gradually or even continuously. More particularly, the light emitter 50 may be adjusted to emit light colors ranging from green to yellow to red as it is indicated by FIG. 4. For example, the light emitter 50 may include a plurality of LEDs to emit different light colors, for example in terms of a LED cluster.

Consequently, the feedback information may be represented by different colors of light.

The feedback indicator 22 and thus, the aforementioned light emitter 50 is controlled by a control unit 80 which may, when the light emitter 50 is adjustable in color, vary the color of the emitted light.

Such control unit 80 may take into account different treatment parameters which are detected during operation of the shaver 1 by a plurality of detectors. In addition, the control unit 80 also may be responsive to a history of the values of detected parameters, as will be described in greater detail.

Such detectors may include in particular a force detector 41 for detecting the force with which the working head 3 is pressed onto the body surface 30. Such force detector 41 may include various sensing means such as a sensor measuring diving of the working head 3 towards the handle 2, a sensor measuring bending stresses in the handle or a sensor measuring torque and/or load of a motor driving the working tools which are all representative of contact pressure.

In response to detected pressure or force with which the working head is pressed against the skin, the control unit 80 may vary the color of the emitted light 51. For example, green light may indicate a rather low force, whereas yellow light may indicate an average force and red light may indicate a rather high force. Advantageously, the colors may be changed gradually or continuously to give precise feedback.

Figure 5:
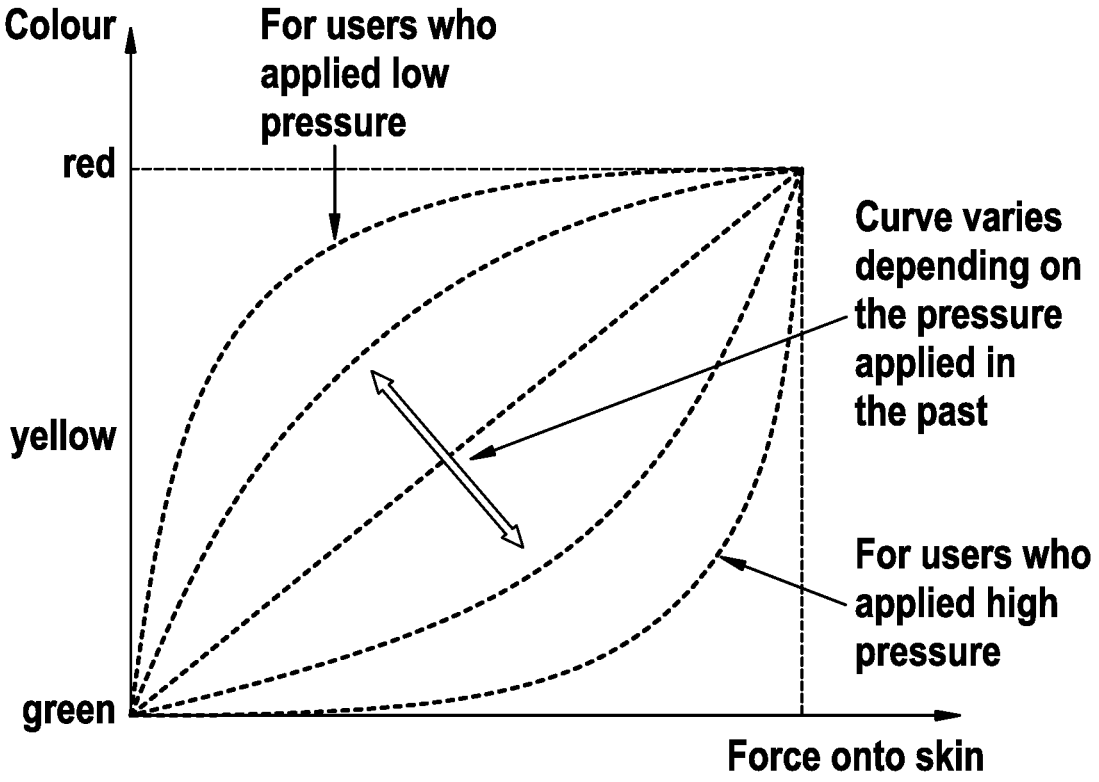
FIG. 5: a schematic diagram showing different functional relations between the detected force onto the skin and the color of the light signals to be emitted, for calibrating the shaver's light emission for users having different operating habits.

So as to have the full range of colors for different users having different habits, a calibration device 60 may calibrate the relation between the color and the detected force, as it is illustrated by FIG. 5. Otherwise a user applying always a rather high force just would get feedback in terms of red light, whereas another user usually applying only a slight force would get feedback only in terms of green light. To avoid such undesired feedback situation, the calibration device 60 may take into account the user history of the detected force values. More particularly, an adaptive controller 61 may vary the curve representing the relation between the color of light and the amount of force. For example, when the user history shows a rather high average force, the adaptive controller 61 may change the normally straight curve to a curve keeping green and/or yellow light for higher force values, i.e. one of the curves on the right side of FIG. 5. On the other hand, if user history shows a rather low average force, the curve may be varied to provide for yellow and/or red light for lower forces already (cf. the left side curves of FIG. 5).

In addition to detection of the aforementioned force, or in addition to such force detection, various other treatment parameters may be detected, wherein the aforementioned calibration device 60 may provide for calibration of the control functions of such other treatment parameters in an analogous way.

More particularly, the following detectors may be provided:

a touch detector 42 for detecting contact of the working head 3 with the body surface 30, a velocity and/or acceleration detector 43 for detecting velocity and/or acceleration of the personal care device, a rotation detector 44 for detecting rotation and/or orientation of the personal care device in three dimensions, a displacement detector 45 for detecting linear and/or rotatory displacement of the working head 3 relative to the handle 2, a cutting activity detector 46 for detecting cutting activity of the personal care device, a trimmer position detector 47 for detecting a position of a long hair trimmer.

The shaver 1 further may be provided with a detecting unit for detecting or measuring other parameters relevant to the skin treatment, wherein such detecting unit may include a voltage and/or current detector for detecting power consumption of the drive unit during shaving and/or a time measurement means for measuring shaving time, for example.

Said control unit 80 may include a micro controller 21 which may receive signals indicative of the aforementioned parameters and may analyze such signals to determine the treatment parameters mentioned above, wherein the indicating means 22 such as the described light emitter 50 may be controlled by the micro controller 21 to indicate to a user feedback. In addition, such feedback information may be communicated to a charging and/or cleaning station.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A personal care device for shaving or removing hair comprising a housing forming an elongated handle for manually moving the personal care device along a body surface, a working head attached to said handle for effecting a personal care treatment to said body surface, at least one detector for detecting at least one treatment parameter of said personal care device, and a feedback indicator for indicating feedback information based on the detected treatment parameter to a user during the personal care treatment, wherein said feedback indicator includes a light emitter configured to emit light from a portion of the elongated handle, wherein a calibration device is provided for calibrating the feedback indicator on the basis of user history of the values of the at least one detected treatment parameter, wherein calibration device is configured to vary a functional relation of light signals emitted by the light emitter to the at least one detected treatment parameter.

2. The personal care device according to claim 1, wherein said light emitter is positioned at an end portion of said handle outside a middle portion of said handle forming a gripping portion.

3. The personal care device in accordance with claim 1, wherein at least one of the following detectors are provided:

a force detector for detecting the force pressing the working head onto the body surface, a touch detector for detecting contact of the working head with the body surface, a velocity and acceleration detector for detecting velocity and acceleration of the personal care device, a rotation detector for detecting rotation and orientation of the personal care device in three dimensions, a displacement detector for detecting linear and rotatory displacement of the working head relative to the handle, a cutting activity detector for detecting cutting activity of the personal care device, a trimmer position detector for detecting a position of a long hair trimmer, wherein said feedback indicator is configured to indicate feedback information based on at least one of the following detected treatment parameters: the force pressing the working head onto the body surface, contact of the working head with the body surface, velocity of the personal care device, acceleration of the personal care device, rotation of the personal care device, orientation of the personal care device in three dimensions, linear displacement of the working head relative to the handle, rotatory displacement of the working head relative to the handle, cutting activity of the personal care device, and the position of a long hair trimmer.

4. The personal care device in accordance with claim 1, wherein the feedback indicator is configured to indicate feedback information based on a current value of the at least one detected treatment parameter and a history of values of said at least one detected treatment parameter.

5. The personal care device according to claim 1, wherein said calibration device calibrates a relation between the feedback indicator and the at least one detected treatment parameter in response to the user history of the values of the at least one detected feedback parameter.

6. The personal care device according to claim 5, wherein said calibration device is configured to vary the functional relation of a color of light emitted by the light emitter to a treatment parameter detected.

7. The personal care device according to claim 6, wherein said calibration device is configured to vary the functional relation of a color of light emitted by the light emitter to a detected force of the working head onto the body surface.

8. A personal care device for shaving or removing hair, comprising a housing forming an elongated handle for manually moving the personal care device along a body surface, a working head attached to said handle for effecting a personal care treatment to said body surface, at least one detector for detecting at least one treatment parameter of said personal care device, and a feedback indicator for indicating feedback information based on the detected treatment parameter to a user during the personal care treatment, wherein the feedback indicator includes a light emitter configured to emit light from an end portion of said elongated handle or from said working head, wherein a calibration device is provided for calibrating the feedback indicator on the basis of user history of the values of the at least one detected treatment parameter, wherein calibration device is configured to vary a functional relation of light signals emitted by the light emitter to the at least one detected treatment parameter.

* * * * *